US005083694A

United States Patent [19]

Lemos

[11] Patent Number: 5,083,694

[45] Date of Patent: Jan. 28, 1992

[54] FASTENER DRIVING DEVICE WITH SEQUENTIAL ACTUATION TRIGGER ASSEMBLY

[75] Inventor: Walter G. Lemos, North Smithfield, R.I.

[73] Assignee: Stanley-Bostitch, Inc., East Greenwich, R.I.

[21] Appl. No.: 713,290

[22] Filed: Jun. 11, 1991

[51] Int. Cl.[5] ..... B25C 1/04

[52] U.S. Cl. ..... 227/8; 227/120; 227/130

[58] Field of Search ..... 227/8, 107, 120, 130; 173/169; 91/461; 251/89, 90, 95

[56] References Cited

U.S. PATENT DOCUMENTS

| | | | |
|---|---|---|---|
| 3,056,965 | 10/1962 | Rogers | 227/130 X |
| 3,467,294 | 9/1969 | Fisher | 227/8 |
| 3,708,096 | 1/1973 | Burke, Jr. | 227/130 |
| 3,784,077 | 1/1974 | Burke, Jr. et al. | 227/8 |
| 3,934,778 | 1/1976 | Males | 227/123 |
| 4,432,483 | 2/1984 | Kuck | 227/8 |
| 4,566,619 | 1/1986 | Kleinholz | 227/130 X |
| 4,629,106 | 12/1986 | Howard et al. | 227/8 |
| 4,767,043 | 8/1988 | Canlas, Jr. | 227/8 |

*Primary Examiner*—Hien H. Phan
*Assistant Examiner*—Raymond D. Woods
*Attorney, Agent, or Firm*—Cushman, Darby & Cushman

[57] ABSTRACT

A portable power actuated fastener driving device having an improved actuating mechanism which includes a spring biased slide member mounted on the trigger member of the device for rectilinear sliding movement thereon between (1) an abutment position with respect to the actuating member and (2) a non-abutment position with respect to the actuating member. A spring biased slide moving member is mounted on the trigger member for movement with respect thereto between first and second positions and has a motion transmitting relationship with a movable member of the work contacting assembly and with the slide member for (1) causing the slide member to be in the non-abutting position thereof when the slide moving member is in the first position thereof so that when the trigger member is manually moved into the operative position thereof without the device being in cooperating relation with a workpiece, the actuating member remains in the inoperative position thereof and (2) enabling the slide member to be biased into the abutting position thereof when the movable member is moved into the operative position thereof so that a manual movement of the trigger member thereafter into the operative position thereof causes the slide member to move the actuating member into the operating position thereof.

19 Claims, 4 Drawing Sheets

10
12
14
24
36
38
42
44
46
48
49
50
52
54
56
58
60
62
64
66
68
70
72
74
76
78
80
82
84
86
88
90
92
94
96
98
3

58
80
56
36
86
96
83
82
90
76
38
92

FASTENER DRIVING DEVICE WITH SEQUENTIAL ACTUATION TRIGGER ASSEMBLY

This invention relates to fastener driving devices and, more particularly, to portable power-actuated fastener driving devices.

Power actuated fastener driving devices of the type herein contemplated are, for the most part, of the fluid pressure operated type, although solenoid operated devices and internal combustion operated devices are also contemplated. Most portable power actuated fastener driving devices are provided with an actuating mechanism which includes two components; one, a trigger member and two, a contact trip member. These members are interrelated by an enabling mechanism which causes an actuating member to be moved when both the contact trip and trigger members are moved from their normal inoperative positions into their operative positions. The contact trip member is moved from its normal inoperative position into its operative position by movement of the portable device into engagement with the workpiece. The trigger member is moved by a digital pressure by the operator. It is well known that actuating mechanisms can be either of the sequential type or of the concomitant type. A sequential actuating mechanism requires the operator to move first the contact trip member into its operative position and then the trigger member into its operative position in order for the actuating member to be moved. The concomitant type is one in which the actuating member will move in response to the movement of both the contact trip and trigger member into their operative positions irrespective of the order in which they are moved therein. The present invention is particularly directed to the sequential type of actuating mechanisms.

Examples of sequential type actuating mechanisms are disclosed in commonly assigned U.S. Pat. No. 3,784,007. In the embodiment shown in FIGS. 14–17, a spring pressed lever is pivoted on the trigger member and has a motion transmitting relation both with the movable member of the contact trip assembly and the actuating member. The motion transmitting connection between the spring pressed lever pivoted on the trigger and the actuating member required that a pin be inserted through the actuating member. It is sometimes desirable to be able to equip a given fastener driving device alternatively either with a sequential actuating arrangement or a concomitant actuating arrangement. The present invention is based upon the concept that this desirability can best be accomplished when the two alternative mechanisms can be simply substituted for one another at the factory in a manner which permits substitution of trigger mechanisms without the necessity to modify or provide special connections with the movable member of the contact trip assembly or the actuating member of the actuating valve assembly. Trigger assemblies of the concomitant type are available which meet this criteria.

An object of the present invention is to provide a sequential trigger assembly which likewise will meet this criteria. In accordance with the principles of the present invention, this objective is accomplished by providing a fastener driving device which has in addition to the usual movable member of the work contact assembly and the actuating member of the power control arrangement, a slide member mounted on the trigger member for rectilinear sliding movement thereon between (1) an abutment position with respect to the actuating member wherein the slide member is disposed to engage the actuating member in motion transmitting relation to move the same from the inoperative position thereof to the operative position thereof in response to the manual movement of the trigger member from the inoperative position to the operative position thereof and (2) a non-abutment position with respect to the actuating member wherein the slide member is disposed to be out of engagement with the actuating member so that the actuating member remains in the inoperative position thereof in response to the manual movement of the trigger member from the inoperative position to the operative position thereof. The first spring is operatively associated with the slide member for resiliently biasing the slide member toward the abutting position thereof. A slide moving member is mounted on the trigger member for movement with respect thereto between first and second positions. A second spring operatively associated with the slide moving member for resiliently biasing the slide moving member into the first position thereof. The slide moving member has a motion transmitting relationship both with the movable member and the slide member for (1) causing the slide member to be in the non-abutting position thereof when the slide moving member is in the first position thereof so that when the trigger member is manually moved from the inoperative position to the operative position thereof without the device being in cooperating relation with a workpiece the actuating member remains in the inoperative position thereof and (2) enabling the slide member to be biased into the abutting position thereof by the first spring when the movable member is moved from the inoperative position into the operative position thereof so that a manual movement of the trigger member thereafter into the operative position thereof causes the slide member to move the actuating member into the operating position thereof, and (3) causing the actuating member to remain in the inoperative position thereof when the movable member is moved from the inoperative position to the operative position thereof after the trigger member has been moved into the operative position thereof.

A further object of the present invention is the provision of an actuating mechanism of the type described which is simple in construction, effective in operation and economical to manufacture.

These and other objects of the present invention will become more apparent during the course of the following detailed description and appended claims.

The invention may best be understood with reference to the accompanying drawings wherein an illustrative embodiment is shown.

IN THE DRAWINGS

Figure 1:
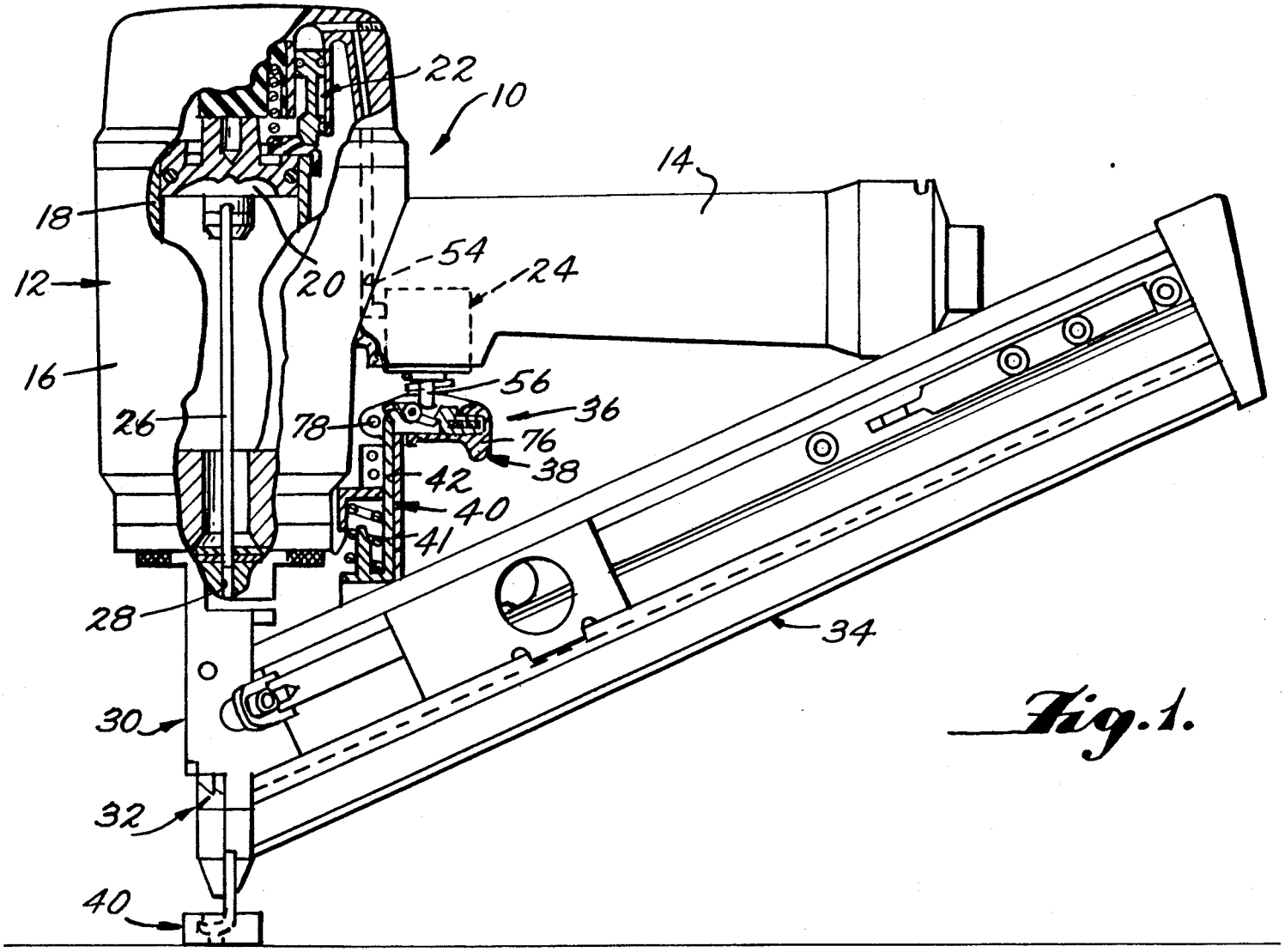
FIG. 1 is a side elevational view, with parts broken away for purposes of clear illustration, of a portable power operated fastener driving device embodying the principles of the present invention.

Referring now more particularly to the drawings, there is shown in FIG. 1 thereof a portable power operated fastener driving device, generally indicated at 10, which embodies the principles of the present invention. The power operated device illustrated is of the fluid pressure operated type and includes the usual portable housing, generally indicated at 12, which includes a handle grip portion 14 of hollow configuration which constitutes a reservoir for air under pressure coming from a source which is communicated therewith. The forward end of the grip portion intersects with a vertical housing portion 16. Mounted within the housing portion 16 is a cylindrical member 18 defining a cylindrical chamber within which a piston 20 is slidably sealingly mounted for movement from an upper position, as shown, through a drive stroke into a lowermost position and from the lowermost position through a return stroke back into its upper limiting position. A main valve, generally indicated at 22, is provided for controlling communication of the reservoir pressure to the upper end of the cylinder to effect the driving movement of the piston. The main valve 22 is pilot pressure operated and the pilot pressure chamber thereof is under the control of an actuating valve mechanism, generally indicated at 24. Means is provided within the housing 12 to effect the return stroke of the piston 20. For example, such means may be in the form of a conventional plenum chamber return system such as disclosed in U.S. Pat. No. 3,708,096, the disclosure of which is hereby incorporated into the present specification.

Figure 3:
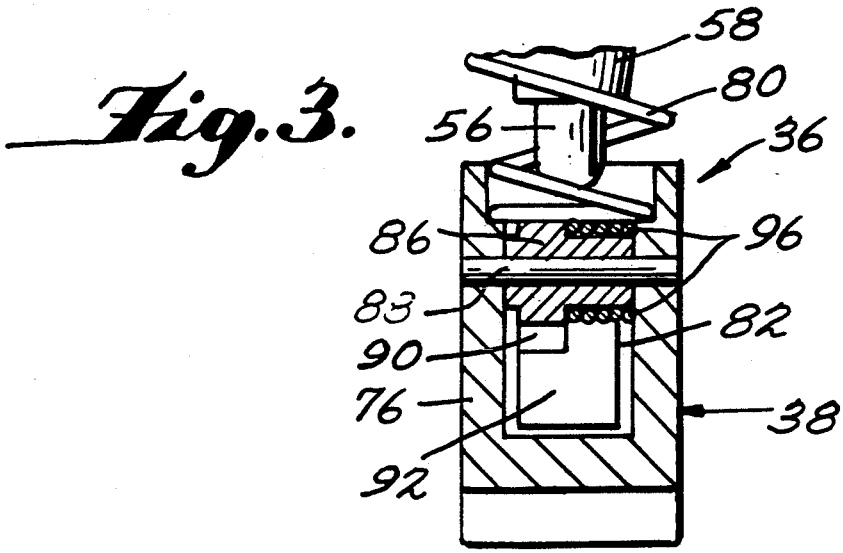
FIG. 3 is a sectional view taken along the line 3—3 of FIG. 2.

In accordance with the usual practice, a fastener driving element 26 is suitably connected with the piston 20 and is slidably mounted within a drive track 28 (see FIG. 3) formed in a nosepiece assembly, generally indicated at 30, forming a fixed part of the housing 12. The nosepiece assembly 30 as illustrated includes a jam-clearing mechanism 32 similar to that disclosed in commonly assigned U.S. Pat. No. 3,934,778, the disclosure of which is hereby incorporated by reference into the present specification. The jam-clearing mechanism 32 embodied in the nosepiece assembly is movable only when it is desired to clear the drive track of a jammed fastener. In normal operation, the nosepiece assembly including the jam-clearing mechanism 32 is operationally rigid. It will be understood that a fully rigid nosepiece assembly without a jam-clearing mechanism may be utilized if desired.

Fixed to the nosepiece assembly 30 is a magazine assembly, generally indicated at 34, which is operable to receive a supply of fasteners and to feed the leading fastener of the supply into the drive track to be driven therefrom by the fastener driving element.

The present invention is more particularly concerned with an improved sequential actuating mechanism 36 for initiating the drive stroke of the fastener driving element 26. The actuating mechanism 36 includes essentially two manually operable assemblies, one of which is a trigger assembly, generally indicated at 38, and the other of which is a work-engaging or contacting assembly, generally indicated at 40. The work-engaging or contacting assembly may assume a variety of different configurations. However, a preferred construction is in accordance with the teachings contained in commonly assigned U.S. Pat. No. 4,767,043, the disclosure of which is hereby incorporated by reference into the present specification. As shown, the assembly 40 includes a work-engaging member which is spring pressed as by spring 41 into a normal inoperative position extending below the end of the nosepiece assembly 30 and movable therefrom when the device is moved into cooperating relation with a workpiece into an operative position against the bias of the spring. The work-engaging assembly 40 includes a movable member 42 which is connected with the work-engaging member to move therewith so that it too moves between a normal inoperative position and an operative position.

Figure 2:
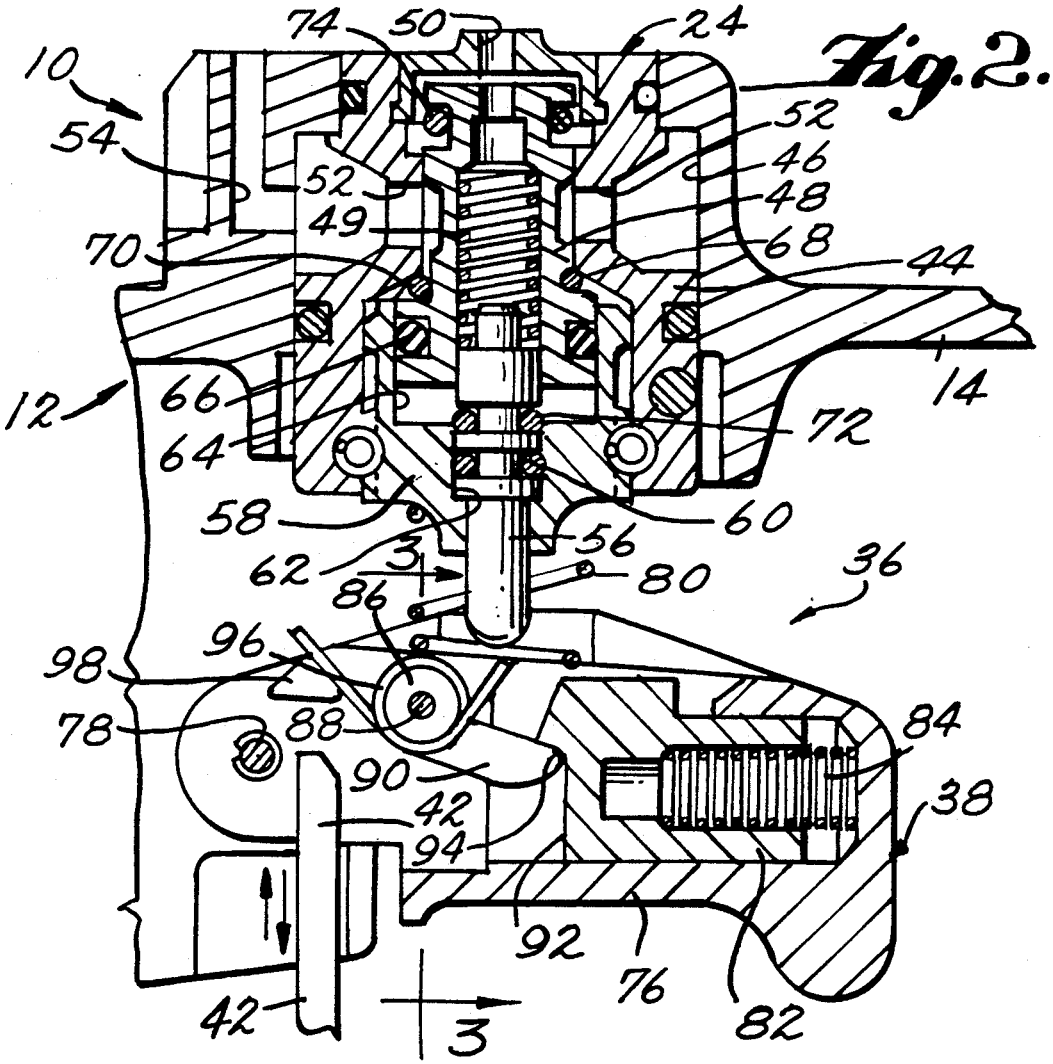
FIG. 2 is an enlarged fragmentary vertical sectional view showing the improved actuating mechanism of the present invention with the parts in their inoperative position.
Figure 5:
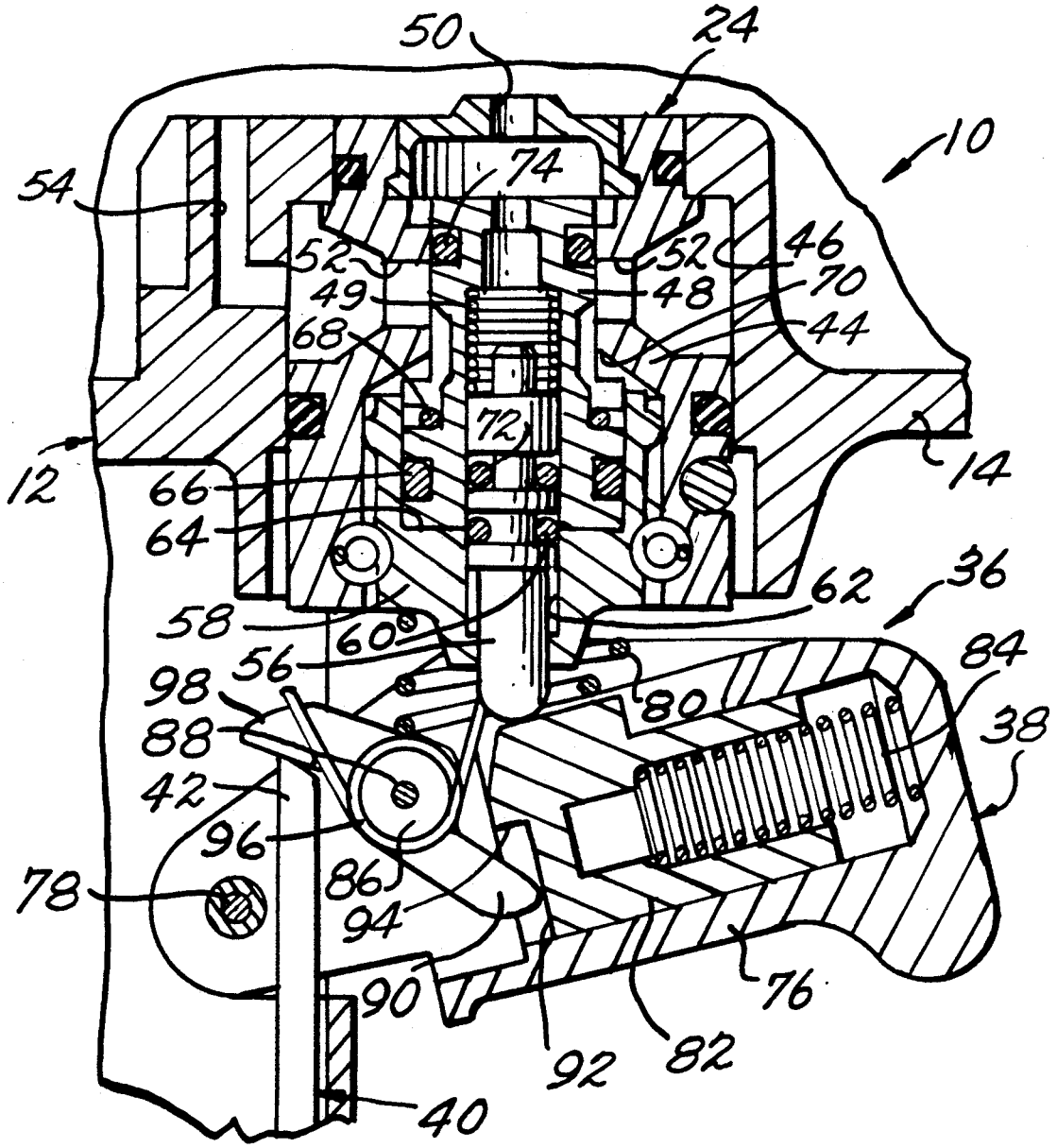
FIG. 5 is a view similar to FIG. 2 showing the position of the parts after sequential actuation.

The valve-actuating mechanism 24 may likewise assume any desired configuration. However, as best shown in FIGS. 2 and 5, the mechanism 24 includes a valve housing 44 sealingly engaged within a recess 46 formed in the handle portion 14 of the housing 12. Mounted within the valve housing 44 is a tubular valve member 48. The valve member 48 is resiliently biased, as by a spring 49, into a normal inoperative position as shown in FIG. 2 wherein a supply of air under pressure within the hollow handle portion 14 of the housing 12 is enabled to pass through an inlet opening 50 in the valve housing 44 and around the tubular valve member 48 through central openings 52 in the valve housing 44 and into a passage 54 which communicates with the pilot pressure chamber for the main valve 22. When the pilot pressure chamber is under pressure, the main valve 22 is in a closed position as shown in FIG. 1. The main valve 22 is pressure biased to move into an open position when the pressure in the pilot pressure chamber is relieved. The pilot pressure is relieved when the tubular valve member 48 moves from the inoperative position shown in FIG. 2 into the operative position shown in FIG. 5. This movement is under the control of an actuating member 56 which is biased by the spring 49 into a normally inoperative position as shown in FIG. 2. The actuating member 56 is mounted for rectilinear movement in a direction toward and away from the trigger assembly 38 which is disposed therebelow within a valve housing section 58 which is mounted within the lower portion of the valve housing in such a way as to provide a vent to atmosphere around the periphery of the valve housing section 58. As shown, the actuating member 56 includes a slide-engaging portion which extends exteriorly of the housing section 58. In the normal inoperative position shown in FIG. 2, an 0-ring seal 60 serves to peripherally seal the actuating member 56 within an opening 62 leading to a control chamber 64 formed in the housing section 58.

As shown, the tubular valve member 48 includes a lower portion having a peripheral seal 66 is mounted within the control chamber 64 and which serves to trap air under pressure within the control chamber 64 entering through the inlet 50 and through the hollow interior of the valve member 48. Pressure from the supply within the hollow handle portion 14 of the housing 12 thus works with the bias of the spring 49 to maintain the tubular valve member 48 in the inoperative position shown in FIG. 2. In this position, a central 0-ring seal 68 engages an annular valve seat 70 on the valve housing to prevent the pressure within the passage 54 and openings 52 from escaping the atmosphere beyond the periphery of the housing section 58.

It will be noted that when the actuating member 56 is moved from the normal inoperative position shown in FIG. 2 to the operative position shown in FIG. 5, the seal 60 moves out of sealing relation within opening 62 so that the pressure within the control chamber 64 is allowed to exhaust to atmosphere beyond the periphery of the actuating member 58 through the opening 62 to the atmosphere. This enables the pressure within passage 54 and openings 52 acting on the O-ring seal 68 carried by the central portion of the tubular valve member 48 in engagement with an annular valve housing seat 70 to move the valve member 48 from the position shown in FIG. 2 downwardly toward the position shown in FIG. 5. The upward movement of the actuating member 56 carries with it a second O-ring seal 72 on the upper portion of the actuating member which engages within the hollow interior of the tubular valve member 48 and seals off the pressure supply to the control chamber 64. The downward movement of tubular valve member 48 carries with it an upper O-ring seal 74 on the valve member 48 into sealing engagement with the adjacent interior of the valve housing 44. In this way, the supply pressure acts upon the tubular valve member 48 to maintain it in its operative position. At the same time, the pressure within passage 54 and openings 52 is relieved through the vent past the periphery of housing section 58. However, it will be noted that the spring 49 is stressed and serves to bias the actuating member downwardly for movement out of its operative position back into the inoperative position thereof shown in FIG. 2. This allows supply pressure to enter the control chamber 64 to return the valve member into its inoperative position wherein pilot pressure passage 54 is pressurized and the main valve 22 is moved into its closed position to permit the piston 20 and fastener driving element 26 to move through a return stroke.

The trigger assembly 38 includes a trigger member 76 which is of generally U-shaped cross-sectional configuration and includes forwardly extending mounting portions through which a pivot pin 78 is engaged so as to mount the trigger member 76 for pivotal movement about the axis of the pivot pin 78 between a normal inoperative position as shown in FIG. 2 and an operative position as shown in FIG. 5. The trigger member 76 is biased into its normal inoperative position by a spring 80 which is connected between the valve housing section 58 and the upper portion of the trigger member 76. The trigger member 76 also includes a generally L-shaped rear wall portion which serves to define a rearward chamber therein within which is mounted a slide member 82 for rectilinear movement with respect to the trigger member 76. As shown, the slide member 82 includes a counterbore in one end thereof within which one end of a compression coil spring 84 is mounted, the opposite end of which engages a leg of the L-shaped wall portion. The coil spring 84 thus serves to resiliently bias the slide member 82 into an abutting position with respect to the actuating member 56, which abutting position is shown in FIG. 2.

A slide moving lever member 86 is pivotally mounted on the trigger member 76 in a position forwardly of the slide member 82 by a shaft 88 providing a pivotal axis which is parallel with the pivotal axis of the trigger member 76. The valve-moving member 86 includes a central hub portion which is journalled on the shaft 88 and a first lever arm 90 extending outwardly from the pivotal axis. The outwardly extending end of the lever arm 90 is formed into a slide surface which is adapted to engage a cooperating slide surface 92 on the lower forward portion of the slide member 82. The slide surface 92 of the slide member 92 terminates upwardly in an abutment surface 94 which is engaged by the lever arm 90 of the slide moving member 86. A torsional coil spring 96 is positioned around the hub portion of the slide moving member 86 and has one end anchored to the trigger member 76 and an opposite end anchored to a laterally extending portion of a second lever arm 98 of the member 86 which extends outwardly from the pivotal axis thereof. It will be understood that the strength of the torsional spring 96 in relation to the strength of the coil spring 84 is such as to cause the slide moving member 86 to pivot into a first position, such as shown in FIG. 2, wherein the engagement of the first lever arm 90 thereof with the sliding surface 92 serves to move the slide member 86 into a non-abutting position wherein the abutment surface 94 is engaged by lever arm 90. The laterally extending portion of the second lever arm 98 is disposed in a position to be engaged and moved into a second position as shown in FIG. 5 by the upper end of the movable member 42 of the work contacting assembly 40 when the latter is moved from its inoperative into its operative position.

OPERATION

FIG. 2 illustrates the position of the parts of the actuating mechanism 36 in its normal at-rest condition preparatory to use. It will be noted that the movable member 42 of the work contacting assembly 40 is maintained by spring 41 in its normal operative position and that spring serves to bias the actuating member in its normal inoperative position. Similarly, spring 80 serves to bias the trigger member 76 into its normal inoperative position. Finally, it will be noted that the torsion spring 96 serves to bias the slide moving member 86 into its first position which retains the slide member 82 in its non-abutting position against the bias of spring 84.

Figure 4:
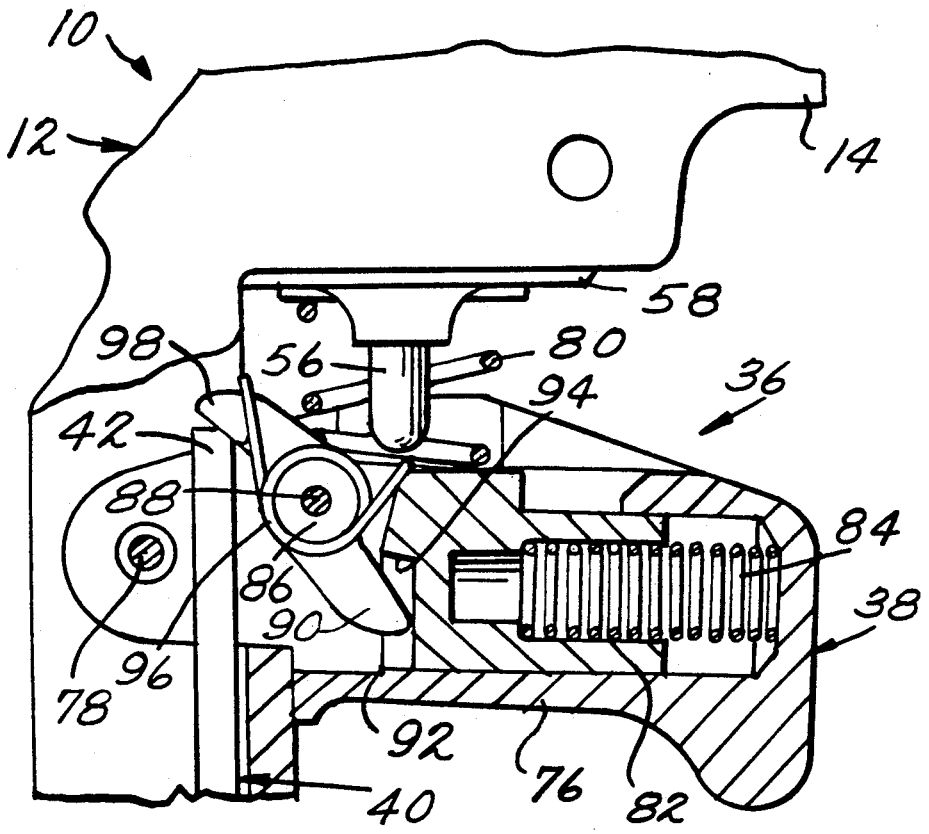
FIG. 4 is a fragmentary elevational view of the actuating mechanism with parts broken away for purposes of clear illustration showing the parts in the position assumed following the movement of the device into cooperating relation with a workpiece.

The actuating mechanism 36 is operable to actuate the main valve 22 only when a predetermined sequence of manual actuating procedural steps are performed by the operator. The first of these actuating procedural steps is for the operator to move the device 10 into cooperating relation with the workpiece which is to receive the fastener. When this relationship has been established, the movable member 42 moves from the normal inoperative position thereof into the operative position, which is shown in FIG. 4. During this movement, the upper end of the movable member 42 engages the laterally extending portion of the second lever arm 98 of the slide moving member 86 and serves to move the slide moving member 86, in a clockwise direction as viewed in FIG. 4, from its first position, as shown in FIG. 2, into the second position, which is shown in FIG. 4. During this movement, the first lever arm 90 also moves in a clockwise direction as viewed in FIG. 4 along the sliding surface 92 of the slide member 82 to allow it to be moved from its non-abutting position, as shown in FIG. 2, into its abutting position, as shown in FIG. 4, under the bias of the spring 84. It will be noted that the direction of the sliding rectilinear movement of the slide member 82 under the bias of spring 84 when in motion transmitting relation with the slide moving member 86 is in a direction generally transverse to the rectilinear direction of movement of the actuating member 56. On the other hand, the central portion of the trigger member 76 moves in a direction which is generally the same as the direction of movement of the actuating member 56. Consequently, when the slide member 82 is in its non-abutting position as shown in FIG. 2, a movement of the trigger member 76 will move the slide member 82 along a path which is alongside the actuating member 56 and out of abutting engagement therewith. However, when the slide member 82 has moved into the abutting position as shown in FIG. 4, a pivotal movement of the trigger member 76 will move the slide member 82 through a path which will engage the actuating member 56 in motion transmitting relation thereto.

The next manual actuating procedural step in the sequential actuation is for the operator to digitally effect a movement of the trigger member 76 from its normal inoperative position, as shown in FIG. 2, into the operative position thereof, such as shown in FIG. 5. As previously indicated, during this movement, since the slide member 82 is in its abutting position, the slide member 82 will engage the lower end of the actuating member 56 and move the same from its inoperative position into the operative position thereof, as shown in FIG. 5. As previously indicated, when the actuating member 56 is moved into its operative position, the supply pressure within the control chamber 64 is dumped to atmosphere and the tubular valve member 48 moves downwardly under the supply pressure into the position shown in FIG. 5 wherein the supply pressure within the handle portion 14 is sealed from the passage 54 and the passage 54 is communicated past the periphery of housing section 58 to atmosphere. As previously indicated, when the pilot pressure from the passage 54 is allowed to dump to atmosphere, the pressure acting on the main valve 22 moves the same into its open position which communicates the air pressure supply with the piston 60 to drive the same through its drive stroke together with the fastener driving element 26. The fastener driving element 26 moves the fastener which has been moved into the drive track 28 from the magazine assembly 34 outwardly through the drive track 28 and into the workpiece.

Figure 6:
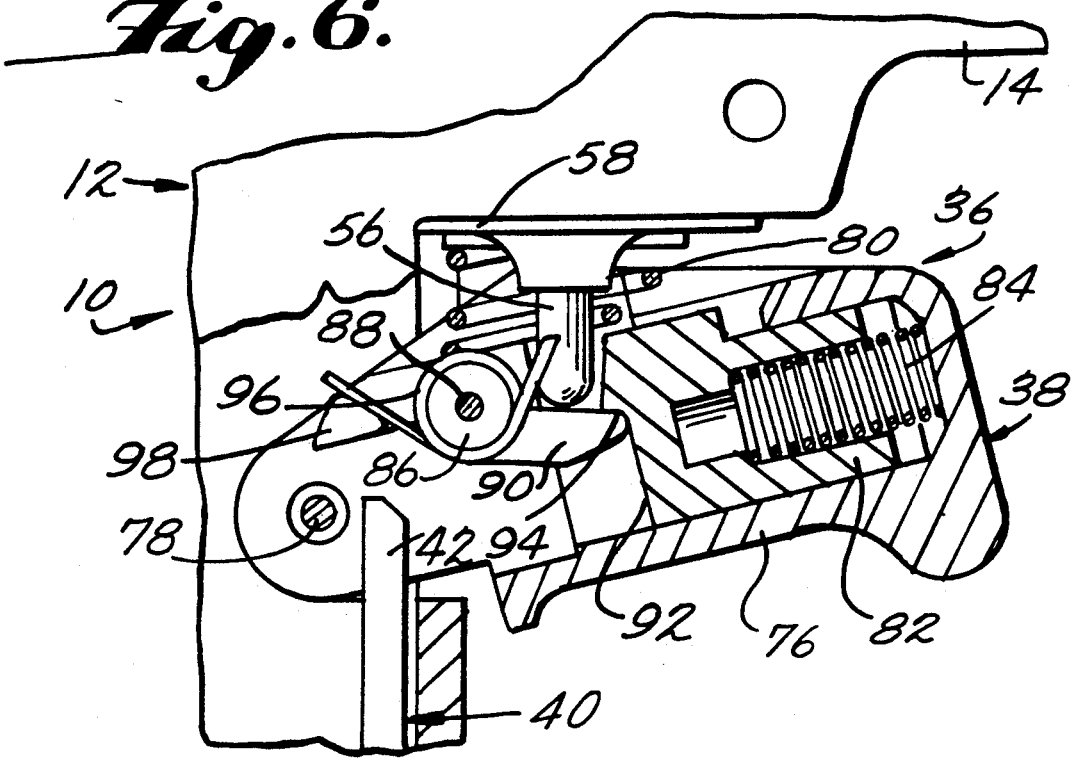
FIG. 6 is a view similar to FIG. 4 showing the position of the parts when the trigger is actuated but the device has not been moved into cooperating relation with a workpiece.

The drive stroke of the piston 20 and fastener driving element 26 causes the device 10 to rebound from the workpiece which has the effect of moving the movable member 42 from its operative position into its inoperative position. This movement allows the torsional spring 96 to pivot the slide moving member 86 back into its first position which has the effect of moving the slide member 82 back into its non-abutting position thus allowing the actuating member 56 to return to its inoperative position even though the operator may still be retaining the trigger member 76 in its operative position. This condition is illustrated in FIG. 6 and it will be noted that, even though the operator should retain the trigger member 76 in its operative position and then move the device 10 back into cooperating relation with a workpiece, the slide member 82 is prevented from moving into its abutting position and, in fact, any movement under the bias of the spring 84 when the slide moving member 86 is moved into its second position will not move the actuating member 56. Thus, the arrangement is such that the operator must return the trigger member 76 into its inoperative position before another actuation can take place.

It will also be noted that FIG. 6 illustrates the position which the parts will assume in the event that the trigger member 76 is moved initially from its inoperative position into its operative position when the device 10 has not been moved into cooperating relationship with the workpiece so that the movable member 42 is in the inoperative position thereof as shown in FIG. 6. Under these conditions, the slide member 82 remains in its non-abutting position and simply moves with the trigger member 76 along a path which is alongside the actuating member 56 and out of engagement and motion transmitting relation with respect thereto. Here again, unless the correct sequence of the two manual movements are observed, actuation will not occur. It is important to note that the arrangement is such that neither the movable member 42 of the work contacting assembly 40 nor the actuating member 56 of the actuating valve mechanism 24 require any adaptation or connection in order for the trigger assembly 38 to effect the desired operation. Thus, the trigger assembly 38 of the present invention enables the manufacturer to replace the sequential trigger assembly 38 of the present invention with a trigger assembly of the concomitant type in which there is a single lever arm carried by the trigger member or vice versa.

It thus will be seen that the objects of this invention have been fully and effectively accomplished. It will be realized, however, that the foregoing preferred specific embodiment has been shown and described for the purpose of this invention and is subject to change without departure from such principles. Therefore, this invention includes all modifications encompassed within the spirit and scope of the following claims.

What is claimed is:

1. A portable power actuated fastener driving device including a portable housing having means defining a drive track, power operated fastener driving means including a fastener driving element carried by said housing for movement within said drive track through successive cycles of operation each of which includes a fastener driving stroke and a return stroke, fastener magazine means carried by said housing for receiving a supply of fasteners and feeding successive fasteners into the drive track in a position to be driven into a workpiece during successive fastener driving strokes of said fastener driving means, power control means including an actuating member carried by said housing for movement from a normal inoperative position into an operative position for initiating the movement of said fastener driving means through a fastener driving stroke, a work contact assembly carried by said housing including a movable member mounted for movement from a normal inoperative position into an operative position in response to a movement of said device into cooperating engagement with a workpiece, a trigger member pivoted to said housing for manual movement from a normal inoperative position into an operative position, a slide member mounted on said trigger member for rectilinear sliding movement thereon between (1) an abutting position with respect to said actuating member wherein said slide member is disposed to engage said actuating member in motion transmitting relation to move the same from the inoperative position thereof to the operative position thereof in response to a manual movement of said trigger member from the inoperative position thereof to the operative position thereof and (2) a non-abutting position with respect to said actuating member wherein said slide member is disposed to be out of engagement with said actuating member so that said actuating member remains in the inoperative position thereof in response to the manual movement of said trigger member from the inoperative position to the operative position thereof, first spring means operatively associated with said slide member for resiliently biasing said slide member toward the abutting position thereof, a slide moving member mounted on said trigger member for movement with respect thereto between first and second positions, second spring means operatively associated with said slide moving member for resiliently biasing said slide moving member into the first position thereof, and means for providing a motion transmitting relationship between said slide moving member and said movable member and between said slide moving member and said slide member for (1) causing said slide member to be in the non-abutting position thereof when said slide moving member is in said first position so that when said trigger member is manually moved from the inoperative position to the operative position thereof without the device being in cooperating relation with a workpiece said actuating member remains in the inoperative position thereof and (2) enabling said slide member to be biased into the abutting position thereof by said first spring means when said movable member is moved from the inoperative position into the operative position thereof so that a manual movement of said trigger member thereafter into the operative position thereof causes said slide member to move said actuating member into the operating position thereof, and (3) causing said actuating member to remain in the inoperative position thereof when said movable member is moved from the inoperative position to the operative position thereof after said trigger member has been moved into the operative position thereof.

2. A fastener driving device as defined in claim 1 wherein said movable member is mounted on said housing for rectilinear movement along a path of engagement and motion transmitting relation with said slide moving member.

3. A fastener driving device as defined in claim 2 wherein said actuating member is mounted on said housing for rectilinear movement in generally the same direction as said movable member, said slide member when moved in motion transmitting relation with said slide moving member with respect to said trigger member moves in a direction transverse to the direction of movement of said actuating member and when moved by and with said trigger member moves in a direction generally in the direction of movement of said actuating member so that (1) when said slide member is in the non-abutting position thereof and is moved by and with said trigger member said slide member moves along a path alongside said actuating member out of engagement therewith and (2) when said slide member is in said abutting position and is moved by and with said trigger member said slide member moves along a path to engage and move said actuating member out of the inoperative position into the operative position thereof and (3) when said trigger member is in the operative position thereof and said slide member is in the non-abutting position thereof a movement of said slide member out of the abutting position thereof will not effect a movement of said actuating member out of the inoperative position thereof.

4. A fastener driving device as defined in claim 3 wherein said slide moving member comprises a lever member mounted on said trigger member for pivotal movements about a pivotal axis in opposite directions into said first and second positions.

5. A fastener driving device as defined in claim 4 wherein said lever member includes a first lever arm extending outwardly of said pivotal axis, said means providing the motion transmitting relationship between said slide moving member and said slide member including interengaging sliding surfaces on said slide member and said first lever arm shaped to cause said slide member to be moved into the non-abutting position thereof against the bias of said first spring means in response to the movement of said slide moving member into the first position thereof under the bias of said second spring means.

6. A fastener driving device as defined in claim 5 wherein said lever member includes a second lever arm extending outwardly from the pivotal axis thereof in generally opposed relation to said first lever arm for engaging said movable member during the movement thereof into the operative position thereof and movement thereby from the first position thereof to the second position thereof during which said slide member is moved by said first spring means from the non-abutting position to the abutting position thereof.

7. A fastener driving device as defined in claim 6 wherein said slide member includes an abutment surface adjacent the sliding surface thereof for engagement by said first lever arm to determine the second position of said slide moving member.

8. A fastener driving device as defined in claim 7 wherein said first spring means is a compression coil spring and said second spring means is a torsion coil spring.

9. A fastener driving device as defined in claim 8 wherein said housing includes a handle portion shaped to be gripped by a hand of the user of the device, said trigger member being pivoted to said housing in a position to be manually moved by digital engagement of the hand of the user gripping the handle portion.

10. A fastener driving device as defined in claim 9 wherein said actuating member is mounted for rectilinear movement within the handle portion of said housing and includes a slide engaging portion extending exteriorly from said handle portion toward said trigger member.

11. A fastener driving device as defined in claim 10 wherein said power control means includes pilot pressure operated main valve means movable from a normally closed position into an open position allowing a supply of air under pressure to be communicated with said fastener driving means to initiate and effect the movement thereof through the fastener driving stroke thereof, and an actuating valve mechanism for controlling the pilot pressure of said main valve, said actuating member forming a part of said actuating valve mechanism.

12. A fastener driving device as defined in claim 1 wherein said slide moving member comprises a lever member mounted on said trigger member for pivotal movements about a pivotal axis in opposite directions into said first and second positions.

13. A fastener driving device as defined in claim 12 wherein said lever member includes a first lever arm extending outwardly of said pivotal axis, said means providing the motion transmitting relationship between said slide moving member and said slide member including interengaging sliding surfaces on said slide member and said first lever arm shaped to cause said slide member to be moved into the non-abutting position thereof against the bias of said first spring means in response to the movement of said slide moving member into the first position thereof under the bias of said second spring means.

14. A fastener driving device as defined in claim 13 wherein said lever member includes a second lever arm extending outwardly from the pivotal axis thereof in generally opposed relation to said first lever arm for engaging said movable member during the movement thereof into the operative position thereof and movement thereby from the first position thereof to the second position thereof during which said slide member is moved by said first spring means from the non-abutting position to the abutting position thereof.

15. A fastener driving device as defined in claim 14 wherein said slide member includes an abutment surface adjacent the sliding surface thereof for engagement by said first lever arm to determine the second position of said slide moving member.

16. A fastener driving device as defined in claim 1 wherein said first spring means is a compression coil spring and said second spring means is a torsion coil spring.

17. A fastener driving device as defined in claim 1 wherein said housing includes a handle portion shaped to be gripped by a hand of the user of the device, said trigger member being pivoted to said housing in a position to be manually moved by digital engagement of the hand of the user gripping the handle portion.

18. A fastener driving device as defined in claim 1 wherein said actuating member is mounted for rectilinear movement within the handle portion of said housing and includes a slide engaging portion extending exteriorly from said handle portion toward said trigger member.

19. A fastener driving device as defined in claim 1 wherein said power control means includes pilot pressure operated main valve means movable from a normally closed position into an open position allowing a supply of air under pressure to be communicated with said fastener driving means to initiate and effect the movement thereof through the fastener driving stroke thereof, and an actuating valve mechanism for controlling the pilot pressure of said main valve, said actuating member forming a part of said actuating valve mechanism.

* * * * *